US007707789B2

(12) United States Patent
Janesky

(10) Patent No.: US 7,707,789 B2
(45) Date of Patent: May 4, 2010

(54) CRAWLSPACE ACCESS PANEL

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 0 days.

(21) Appl. No.: 11/366,952

(22) Filed: Mar. 2, 2006

(65) Prior Publication Data

US 2007/0204530 A1 Sep. 6, 2007

(51) Int. Cl.
*E02D 19/00* (2006.01)

(52) U.S. Cl. ..... 52/169.6; 49/465; 454/276

(58) Field of Classification Search ..... 49/463, 49/465; 454/276; 52/169.6
See application file for complete search history.

(56) References Cited

U.S. PATENT DOCUMENTS

| | | | | |
|---|---|---|---|---|
| 1,044,383 | A | 11/1912 | Hatch | |
| 1,274,996 | A * | 8/1918 | Davis | 454/322 |
| 1,713,101 | A * | 5/1929 | Starrett | 220/241 |
| 2,834,278 | A * | 5/1958 | Crute, Jr. | 454/276 |
| 3,130,659 | A * | 4/1964 | Compton et al. | 454/276 |
| 4,174,008 | A | 11/1979 | Preziosi et al. | 151/69 |
| 4,197,781 | A * | 4/1980 | Giannuzzi | 411/341 |
| 4,890,418 | A | 1/1990 | Sachs | 49/463 |
| 5,327,682 | A | 7/1994 | Holtz | 49/463 |
| 5,653,061 | A | 8/1997 | Hiner | 49/463 |
| 6,149,514 | A * | 11/2000 | Maury | 454/276 |
| D436,926 | S | 1/2001 | Lew | D13/152 |
| D446,317 | S | 8/2001 | Jackson et al. | D25/48 |
| 6,575,666 | B1 * | 6/2003 | Janesky | 52/169.14 |
| 6,618,996 | B1 | 9/2003 | Szyjkowski | 49/465 |
| 6,848,226 | B1 | 2/2005 | Boyd | 52/220.8 |
| 7,097,557 | B2 * | 8/2006 | Kutschman | 454/276 |
| 2002/0184827 | A1 | 12/2002 | Duffy | 49/463 |
| 2004/0072536 | A1 * | 4/2004 | Charron | 454/276 |

* cited by examiner

*Primary Examiner*—John Kreck
(74) *Attorney, Agent, or Firm*—Perman & Green, LLP

(57) ABSTRACT

A crawlspace access panel assembly for covering a crawlspace accessway opening in a building exterior wall is provided. The crawl space access panel assembly having a substantially rigid panel member adapted to cover the opening and a seal attached around a perimeter of the substantially rigid panel. A number of fasteners connected to the substantially rigid panel for removably fastening the substantially rigid panel to the exterior wall, the fasteners being located only on a minimum number of sides of the substantially rigid panel to stably hold the panel to the exterior wall. When fastened the fasteners only on the minimum number of sides of the substantially rigid panel urge the panel against the exterior wall causing the seal to seat around the perimeter so that the substantially rigid panel seals the opening.

23 Claims, 5 Drawing Sheets

CRAWLSPACE ACCESS PANEL

BACKGROUND

1. Field

The present invention relates to a crawlspace access cover.

2. Brief Description of Related Developments

Basements or crawlspaces may allow moisture and water vapor, for example, from dirt or concrete floors, to enter the building structure located above the space causing multiple problems, such as insect infestation or structural problems. A solution exists to provide a lining over the inside of the crawlspace where the lining provides a vapor barrier between the dirt floor or vapor source and the structure to isolate the structure from the high humidity environment. One such system is disclosed in U.S. Pat. No. 6,575,666, which is incorporated by reference herein in its entirety. Further, the accessway opening of conventional basements or crawlspaces, through the building or foundation outerwalls, may nevertheless remain a cause of undesired moisture and outside air infiltration into the basement/crawlspace that compromises and limits the effectiveness of the vapor barrier. For example, conventional crawlspace access panels are primarily decorative in nature and are not sealed in any way such as for example, to prevent the passage of air through the crawlspace opening. Conventional crawlspace panels are typically made of a very thin material on the order of for example, 0.08 inches thick. These panels are also not fastened to the crawlspace opening in a secure manner. As such, these conventional panels do not offer any type of structural barrier against unwanted entry of exterior moisture or hot air (in the hot climates) and cold air (in cold climates) into the crawlspace. As such there is a desire for a crawlspace access panel that overcomes the above deficiencies of these conventional crawlspace access panels.

SUMMARY OF THE EXEMPLARY EMBODIMENT(s)

The present invention is directed to a crawlspace access cover. In one exemplary embodiment, a crawlspace access panel assembly for covering a crawlspace accessway opening through a building exterior wall is provided. The crawlspace access panel assembly includes a substantially rigid panel member adapted to cover the opening. A seal attached around a perimeter of the substantially rigid panel. A number of fasteners connected to the substantially rigid panel for removably fastening the substantially rigid panel to the exterior wall. The fasteners being located only on a minimum number of sides of the substantially rigid panel to stably hold the panel to the exterior wall. When fastened the fasteners only on the minimum number of sides of the substantially rigid panel urge the panel against the exterior wall causing the seal to seat around the perimeter so that the substantially rigid panel seals the opening.

In another exemplary embodiment, a crawlspace access panel assembly for covering a crawlspace accessway opening through a building exterior wall is provided. The assembly includes a structural foam panel adapted to cover the opening. A sealing member attached around a perimeter of the structural foam panel, the sealing member being on a side of the structural foam panel member, wherein the sealing member effects sealing between the structural foam panel member and the building exterior wall. A number of fasteners connected to the substantially rigid panel for removably fastening the substantially rigid panel to the exterior wall. When fastened only one pair of fasteners will stably seat the panel on the exterior wall and cause the sealing member to seal the opening around the perimeter of the panel. The structural foam panel is removably secured to the building exterior wall.

In accordance with an exemplary embodiment, a method of installing a crawlspace access panel assembly for covering a crawlspace accessway opening through a building exterior wall is provided. The method includes providing a substantially rigid panel having a seal attached around a perimeter of the substantially rigid panel. Providing at least two removable fastening members each having an anchor and a knob/screw assembly for insertion into the anchor. Securing the anchors of the at least two removable fastening members within the building exterior wall on opposite sides of the crawlspace accessway opening. Placing the substantially rigid panel over the crawlspace accessway opening in the building exterior wall and removably inserting the knob/screw assembly of the at least two removable fastening members through a corresponding aperture in the substantially rigid panel and into a corresponding anchor.

BRIEF DESCRIPTION OF THE DRAWINGS

The foregoing aspects and other features of the present invention are explained in the following description, taken in connection with the accompanying drawings, wherein.

DETAILED DESCRIPTION OF THE EXEMPLARY EMBODIMENT(s)

Figure 1A:
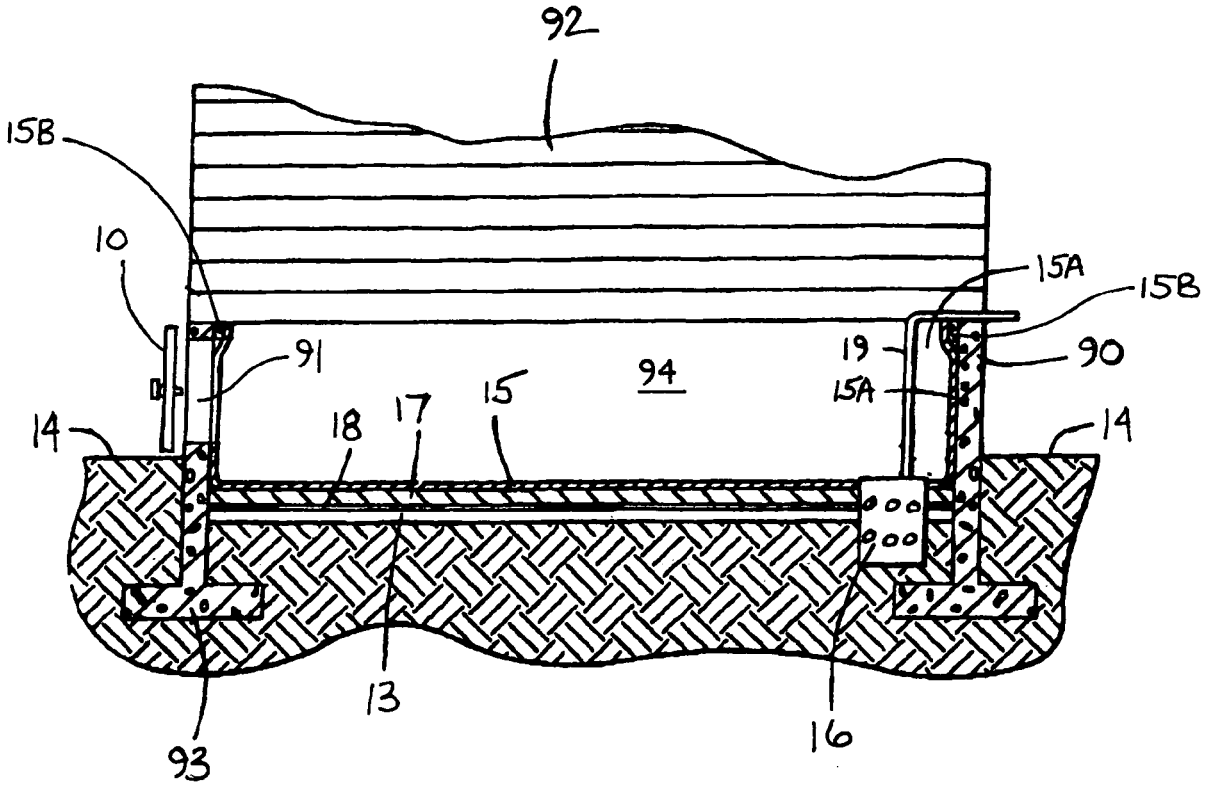
FIG. 1A is a side elevation view of a building having a crawlspace encapsulated according to an exemplary embodiment, shown partially in cross-section.
Figure 1B:
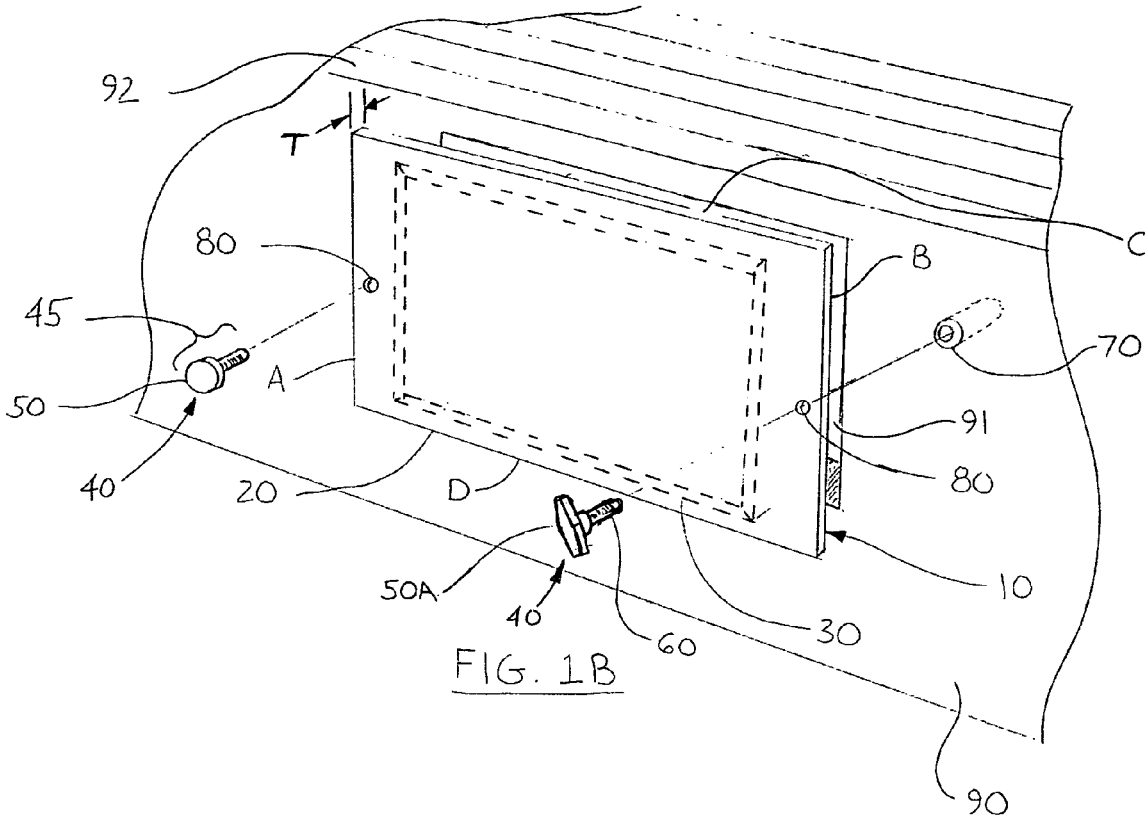
FIG. 1B is an isometric exploded view of a crawlspace access cover assembly in accordance with an exemplary embodiment.

Referring to FIGS. 1A and 1B, an elevation view of a building having a crawlspace access cover 10 in accordance with an exemplary embodiment and an exploded view of a crawlspace access cover assembly 10 are shown. Although the embodiments will be described with reference to the exemplary embodiments shown in the drawings, and described below, it should be understood that the present invention can be embodied in many alternate forms of embodiments. In addition, any suitable size, shape or type of elements or materials could be used.

Referring now to FIGS. 1A and 1B, a building 92 such as a house is illustrated supported upon peripheral foundation walls 90 on a peripheral footing 93 buried in the ground beneath the frost line. Also an access opening 91 may be provided in the foundation 90, above ground level 14. The opening 91 may be sized to allow a person passage through the opening to go inside the crawlspace. Alternatively, a hatch door may be provided in the roof or ceiling to permit access into the crawlspace when necessary. Any air vents present in the crawlspace walls 90 or foundation may be sealed or covered with a crawlspace liner or otherwise as air circulation may not be desired after the crawlspace is sealed. Floor 17 of the crawlspace may be poured concrete, or may be a dirt floor. In alternate embodiments the crawlspace floor may be provided with an inner peripheral water drainage trench 18 or tile filled with aggregate and may contain a perforated water drainage conduit 13. The trench may open to a sump pit which, depending upon the slope of the terrain, may contain a sump pump (not shown) and a discharge pipe 19 (shown in FIG. 1A and representing the sump pump connected thereto) which extends up and over the foundation and drains to an external location whenever the water level of the sump pit rises to the activation level of the sump pump. In the exemplary embodiment, a pit or void 16 may be formed in the crawlspace floor 17. The pit 16, which may be excavated through the existing floor may not have a pump or reservoir or pipe 19. Pit 16 may have a drain and alarm system (not shown) adapted for use with, for example, a crawlspace liner 15 encapsulating the crawlspace and sealing the floor 17 or other seal barrier sealing the floor. As disclosed in U.S. patent application entitled "CRAWLSPACE DRAIN AND ALARM SYSTEM", filed on Jan. 30, 2006, and incorporated by reference herein in its entirety, the crawlspace may have an accessway with an opening 91 and in an outer wall of the foundation 90. The opening is closed with a cover assembly 10 having a rigid panel member 20, a sealing member 30, and removable fasteners 40. The removable fasteners 40 include wall anchors 70.

In the exemplary embodiment shown, the liner 15 extends over and seals the crawlspace floor 17, and may also have portions 15A extending over and sealing other portions of the crawlspace boundaries, such as the foundation walls 90. In alternate embodiments, the liner may have any desired shape. In still other embodiments, any suitable vapor barrier such as a sealed concrete floor may be used to encapsulate the chamber. In this embodiment continuous sealed crawlspace liner 15 is provided, such as of plastic film, which may be monofilm, for example, a sixteen mil thick durable heavy duty, fiber-reinforced multi-ply plastic film or rubber sheeting. The crawlspace liner 15 may be for example an integral continuous durable water barrier film or laminate or may be formed of wide strips of such film or laminate, such as six feet in width, which are overlapped and sealed along the edges thereof with waterproof caulk or adhesive tape to provide a continuous sealed barrier liner 15 of the required dimensions. The crawlspace liner 15 may be installed over the dirt floor 17 and over the sump pit 16, if present, and may be extended vertically-upward to the tops of the crawlspace walls. The liner 15 may be sealed against the inner surface of the foundation walls 90 peripherally surrounding and enclosing the crawlspace. The liner 15 may be sufficiently durable to resist tearing and piercing under the weight of the installers. The upper surface of the liner 15 may be white in color to brighten the crawlspace. The vertical peripheral crawlspace liner extensions 15A are extended and supported against the inner surfaces of the foundation walls 90 and sealed thereto at an elevation which is above the exterior ground level, for example, to the tops of the foundation walls. The continuous marginal liner extensions 15A are sealed or bonded to each other and to the entire peripheral inner wall of the foundation 90 adjacent the top thereof, for example, by use of an adhesive tape or a continuous bead 15B of suitable adhesive or caulk composition such as a polyurethane composition. Nylon fasteners may be used to support the liner 15 vertically over the foundation 90 during installation and prior to caulking. The crawlspace liner 15 and its extended marginal border areas 15A prevent the entry of water vapor from the soil or ground into the crawlspace environment and prevent external ground water or flood water entry into the crawlspace and on top of the crawlspace liner 15, over the dirt floor 17, where it can become trapped and stagnant and can generate mold and fungus and water vapor which can deteriorate and rot structural wood support members of the building 92. Any exterior ground water which might penetrate the foundation 90, such as through a cement block wall, is trapped beneath the liner extensions 15A and flows down into the dirt floor of the crawlspace and into the drain tile channel 18, if present. This keeps the head space 94 of the crawlspace, or the crawlspace environment, dry. Thus, the installed crawlspace liner may totally encapsulate the crawlspace environment and completely isolates the building envelope and upper living spaces from the earth there below and from the dampness, insects and radon contained therein, to provide a healthier home environment.

According to an exemplary embodiment, the rigid panel member 20 is shown in FIG. 1B as being rectangular in shape. In alternate embodiments the panel member may be any suitable shape. The panel member 20 may be provided for example, as a two-foot by four-foot panel. In alternate embodiments the panel member may be provided in any suitable size to sufficiently cover a crawlspace opening. In alternate embodiments, the panel member 20 may be made utilizing any suitable manufacturing method with any suitable corrosion resistant material. For example, the panel member 20 may be made of solid plastic or a plastic structural foam and produced through injection molding. The plastic may be for example, polyethylene or polypropylene. The plastic may be dyed so that the panel member 20 may be molded in a predetermined color such as for example, black, gray, white or any other suitable color, so that the panel member 20 will not need painting.

The structural foam may allow the panel member 20 to be more rigid than a solid panel of the same size and have a high strength to weight ratio. The structural foam process allows for the production of rigid plastic products that have a cellular foamed core surrounded by an outer skin forming a completely integrated structure. Because of the lighter weight resulting from the structural foam process, the panel member 20 may be easier to install than a panel made of solid material.

In accordance with an exemplary embodiment, the panel member may have a thickness T for example, in the range of one-quarter of an inch to one inch. In alternate embodiments the panel member may be any suitable thickness. In alternate embodiments, the thickness T of the panel 20 may be variable. For example, the side of the panel member 20 facing the wall may be flat while the opposite side of the panel member 20 may be generally ramped or pitched in shape with the center of the panel being the thickest point. The thickness T of the panel member 20 by itself, or when combined with the increased rigidity resulting from the structural foam, may allow the panel member 20 to provide a secure cover that is functionally capable of preventing unwanted access into the crawlspace. The rigidity or stiffness of the panel member 20 may also allow for the use of fasteners on a minimum number of sides when securing the panel member 20 to a foundation or wall 90, or a ceiling (not shown). As can be seen in FIG. 1B, for example, one removable fastener may be used on each of two sides A, B of the access panel member 20 to stably hold the panel to the foundation or wall 90. The rigidity of the access panel member 20, as described above, may allow for an equal pressure distribution around the perimeter of the access panel 20 against the foundation or wall 90 so that when, for example, the two sides A, B of the access panel 20 are secured against the foundation or wall 90 with removable fasteners 40 the substantially rigid panel 20 urges the panel against the foundation or wall 90 causing the seal 30 to seat around the perimeter of the opening 91 so the panel 20 seals the opening 91. In alternate embodiments, any number of fasteners or sides may be used in securing the panel 20 to the foundation or wall 90.

Figure 2:
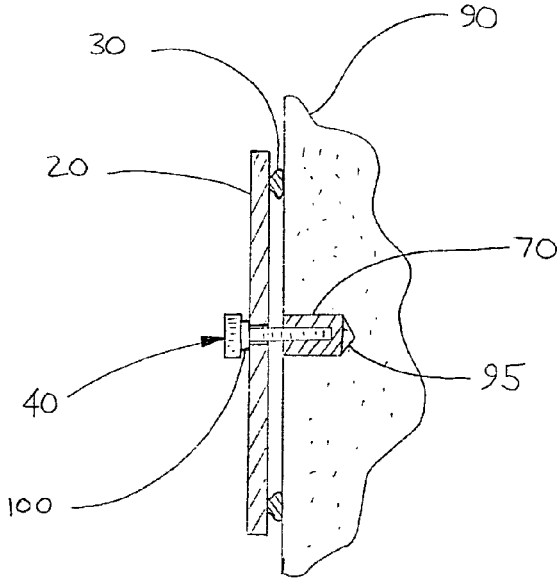
FIG. 2 is a section view of a crawlspace access cover assembly in accordance with an exemplary embodiment.

As can be seen in FIG. 1B, the panel member 20 has two through holes 80 located along opposite sides A, B of the panel member 20. In alternate embodiments any number of through holes may be located along any side of the panel member 20, for example sides A, B, C and D. Through holes 80 may be of a sufficient size to allow for example, the treaded rod portion 60 of the removable fastener 40 to pass through the panel member 20. Although each of the through holes 80 are shown in FIG. 1B as being cylindrical in shape, in alternate embodiments one or more of the holes may be elongated. For example, the hole 80 along side A of the panel member 20 may be a slot running parallel with side A. This elongated slot may aid in the installation of the panel member 20 when the hole 80 in the panel member 20, for example, is not substantially in-line with a hole 95 (as seen in FIG. 2) which is made to receive the wall anchor 70 to which the threaded rod 60 of fastener 40 is inserted. For example, a user/installer may insert one fastener in hole 80 along side B of the panel member 20 and rotate the panel member 20 so the slotted hole (not shown) along side A lines up with a corresponding hole 95 and wall anchor 70 in the foundation or wall.

Still referring to FIG. 1B, the sealing member 30 may be made of any suitable material to make or form an airtight seal with an irregular or rough surface such as for example, a masonry wall or textured ceiling. For example, the sealing member 30 may be made of weather stripping. The sealing member may have a suitable cross section to form an airtight seal between the panel member 20 and wall or foundation 90. The sealing member 30 may be fixedly attached around a perimeter of the panel member 20 on the side of the panel member 20 that will face the wall or foundation 90 when the panel member 20 is installed, as can be seen in FIG. 2. The sealing member 30 may be fixedly attached to the panel member 20 with any suitable adhesive such as for example, a glue type adhesive or a tape adhesive. In alternate embodiments, any suitable type of fastening method may be used to fix the seal member 30 to the panel member 20.

The removable fasteners 40, as shown in FIG. 1B, may have a knob and screw assembly 45 and a wall anchor 70. The knob and screw assembly 45 has a knob 50, 50A and a threaded rod 60. The knob may have any suitable shape, such as for example, the circular shaped knob 50 or the generally "T" shaped knob 50A so that sufficient grip may be exerted on the knob to allow tightening of the fastener 40. The circular knob 50 may be spun by grasping the perimeter of the knob 50 and rotating the knob either clockwise or counterclockwise. The generally "T" shaped knob 50A may be spun by striking or rotating one side of the "T" about the center of the knob 50A. The knob 50, 50A may also have a shoulder 100, as seen in FIG. 2, so that when the fastener 40 is tightened the shoulder 100 presses against the panel member 20 so that the panel member 20 is securely held against the foundation or wall 90. The threaded rod 60 may be molded into the knob 50, 50A. In alternate embodiments, the threaded rod 60 may be screwed into the knob 50, 50A and secured with a high strength thread locker or cross pin. In other embodiments the threaded rod 60 may be fixed within the knob 50 by any suitable means. In still other alternate embodiments, the treated rod may be fixed to the anchor 70 so that a knob with a threaded hole may be threaded onto the anchor/rod assembly. In other alternate embodiments the fasteners 40 may have any other configuration such as rotatable clasps or catches.

The knob 50, 50A and threaded rod 60 may be made of corrosion resistant material, such as for example nylon or plastic. In alternate embodiments the knob and threaded rod may be made from stainless steel, zinc or a material having a galvanized or zinc coating. In yet other alternate embodiments any suitable material may be used. It should be noted that the knob 50, 50A and the rod 60 do not have to be made of the same material, for example both the knob 50, 50A and the threaded rod 60 may be made of plastic or nylon or the knob may be made of plastic and the rod may be made of zinc. Any suitable combination of materials may be used for the knob and threaded rod.

Figure 5:
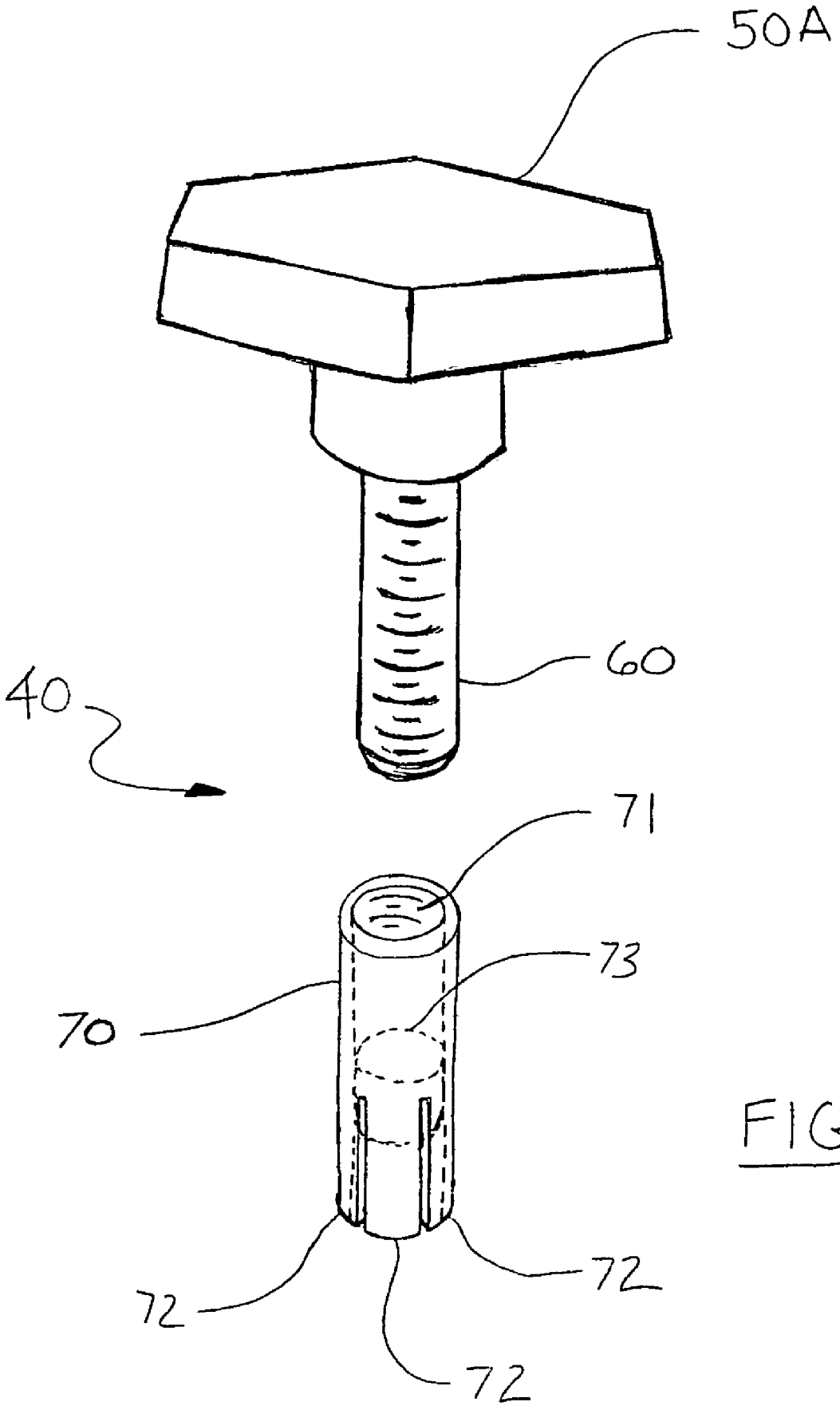
FIG. 5 shows a fastener of a crawlspace access cover assembly in accordance with an exemplary embodiment.

Referring also to FIG. 5, the wall anchor 70 may be adapted to be placed in any type of material such as for example, wood, drywall or masonry. When inserting the wall anchor 70 into, for example, a masonry or concrete foundation, the wall anchor 70 may be cylindrical in shape and divided into a front and back portion. The front portion of the anchor 70 or the portion of the wall anchor 70 that receives the threaded rod 60, may have internal threads 71 and the back portion of the anchor may be slotted to form a plurality of expandable arms 72 that extend longitudinally along the axis of the anchor 70. There may be, for example, a tapered insert 73 (shown with phantom lines) located within the anchor 70 such that, when the threaded rod 60 is screwed into the threaded or front portion of the anchor 70, the tapered insert 73 is forced into the back portion of the anchor 70 causing the expandable arms 72 to expand outward thereby gripping the inside of the hole in which the anchor 70 is placed. In alternate embodiments, any suitable type of wall anchor may be used. The anchor 70 may be made of a corrosion resistant material such as plastic, nylon, stainless steel, zinc or a material having a galvanized or zinc coating. In alternate embodiments any suitable material may be used. In yet other alternate embodiments, any suitable fastening system may be used to secure the panel member 20 to the wall 90.

Figure 3:
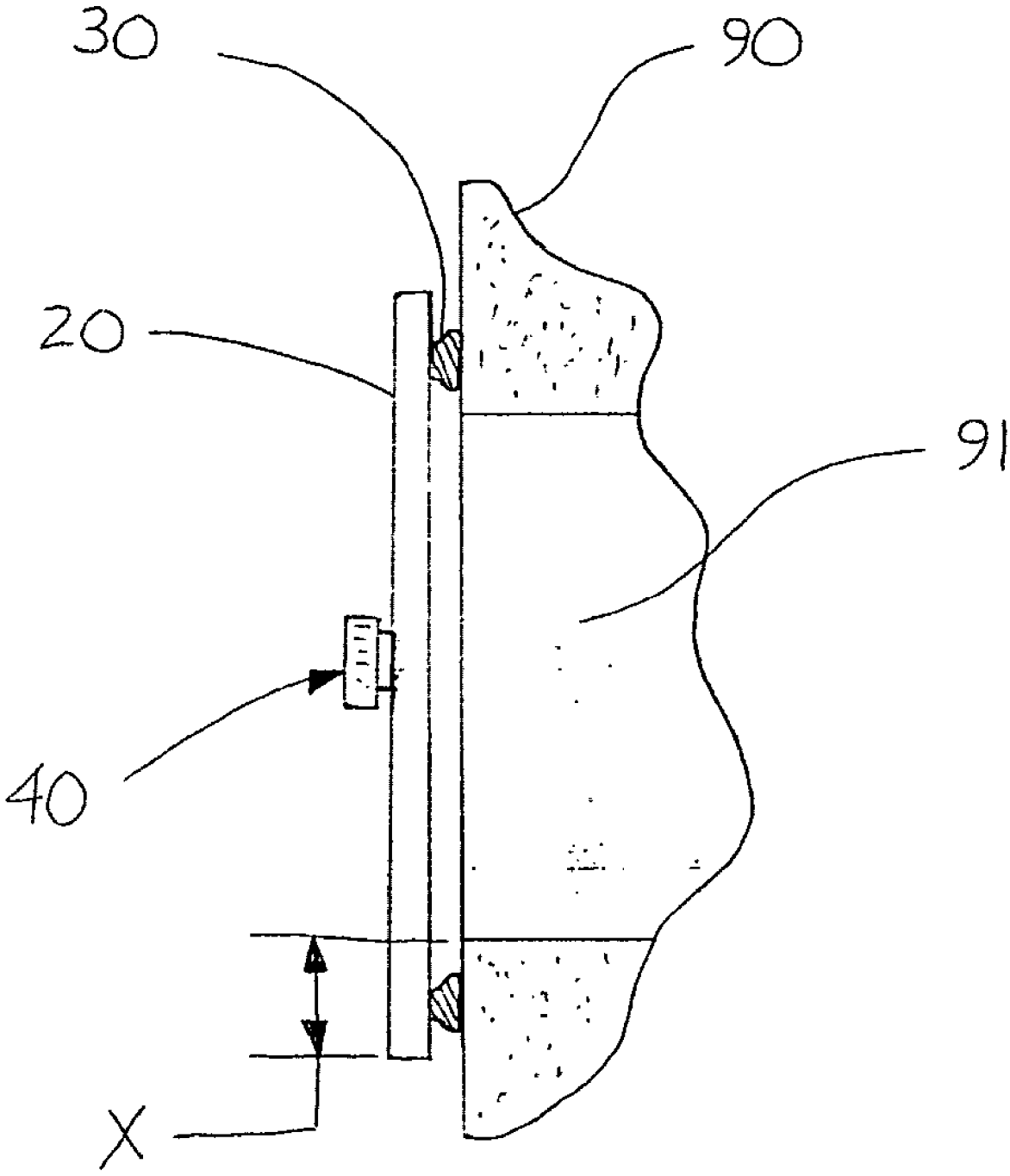
FIG. 3 is a partial section view of a crawlspace access cover assembly in accordance with an exemplary embodiment.
Figure 4:
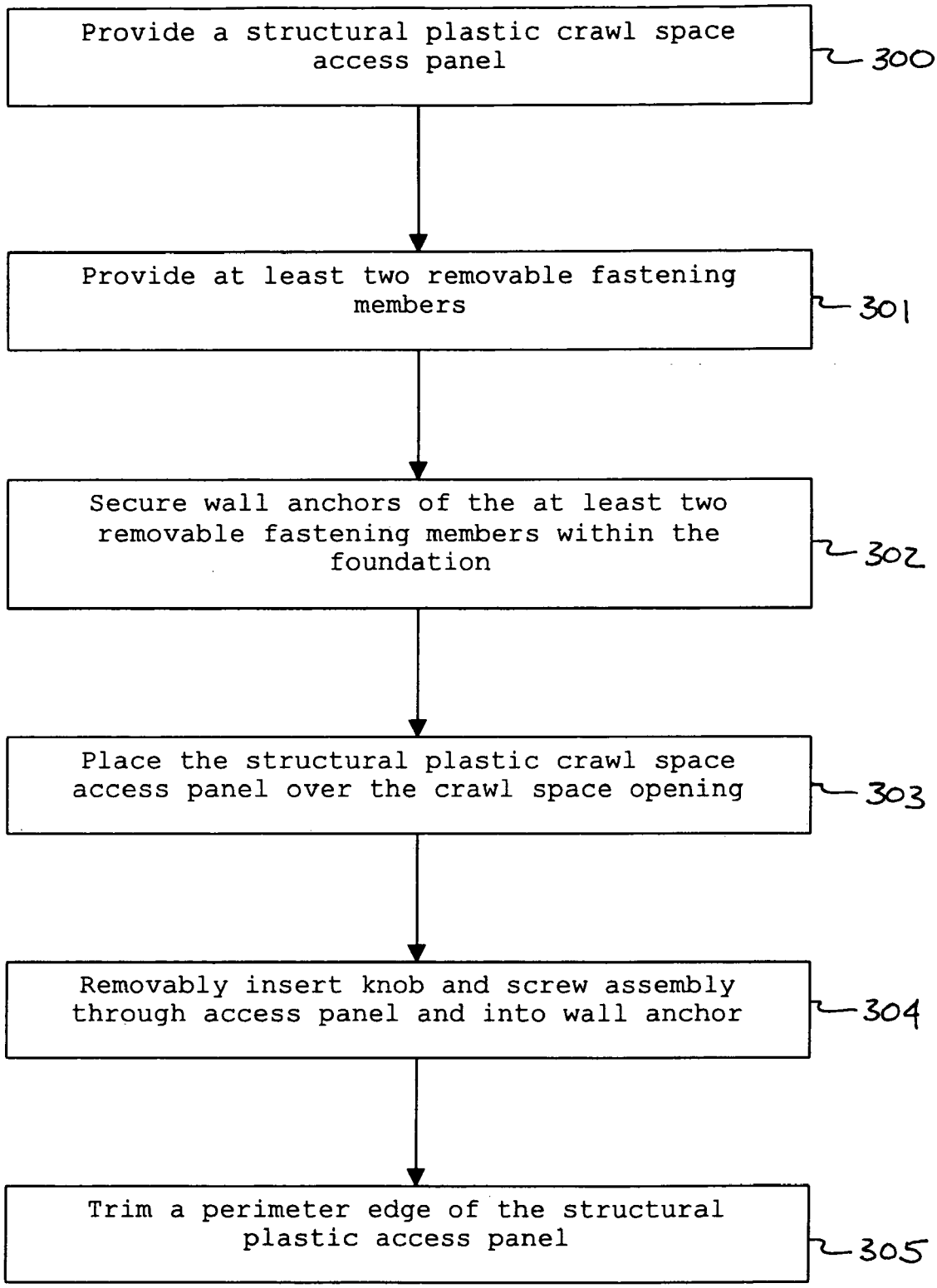
FIG. 4 is a flow diagram according to a method of an exemplary embodiment.

Referring now to FIGS. 2, 3 and 4, a method of installing a crawlspace access panel in accordance with an exemplary embodiment will now be described. Although the installation of the access panel will be described as being installed on a masonry foundation wall, the access panel may be installed on any other suitable wall surface made of any type of material such as for example, floors and ceilings.

In accordance with an exemplary embodiment, a crawlspace access panel member 20 is provided (Block 300, FIG. 4). The panel member 20 has a sealing member 30 as described above. The sealing member 30 may be provided to the user/installer preinstalled on the access panel 20 or the seal 30 may be provided for the user to install on the access panel 20. At least two removable fastening members 40, as described above, are also provided (Block 301, FIG. 4).

The user/installer forms holes such as for example, blind hole 95 in the foundation. The holes may be made with a masonry drill bit of a suitable size so that the wall anchors 70 fit snuggly within the holes 95. In alternate embodiments any suitable tool may be used to form holes for the wall anchors. The holes 95 may also be of a suitable depth to allow the wall anchors 70 to sit flush with or below the surface of the foundation wall 90. The hole pattern made in the foundation around the crawlspace opening 91 corresponds to the hole pattern of the holes 80 on the panel member 20. Because the panel member 20 overlaps the crawlspace opening 91, as shown in FIG. 3, the panel member 20 itself may be used as a template when forming the holes 95. The user/installer presses the wall anchors 70 into the holes 95 (Block 302, FIG. 4). In alternate embodiments a suitable adhesive may be used to secure the wall anchors within the holes.

The user/installer places the panel member 20 over the crawlspace opening so that the seal 30 is between the panel member 20 and the surface of the foundation wall 90, as shown in FIG. 2 (Block 303, FIG. 4). The knob and thread assemblies 45 are inserted, by the user/installer through the holes 80 in the access panel 20 and into the wall anchors 70 (Block 304, FIG. 4). The knob and thread assemblies 45 may be screwed into the wall anchors 70 so that the wall anchors arms may expand, as described above, within the holes 95, securing the wall anchors 70 within the holes 95. In alternate embodiments, the user/installer may insert one of the knob and thread assemblies and rotate the panel member 20 so that the remaining holes 80 are in line with their corresponding holes 95 in the foundation wall. The tightening of the knob and thread assemblies 45 causes the shoulder on the knob 50, 50A to press against the panel member 20 thereby causing the seal 30 to compress between the panel member 20 and the foundation wall 90 as shown in FIGS. 2 and 3. As discussed above, the rigidity of the panel member 20 allows for the even compression of the seal member 30 along the perimeter of the panel member 20 while using a minimum number of removable fasteners. The even compression of the seal 30 may create an air tight seal between the panel member 20 and the foundation wall 90. The user/installer may optionally cut the perimeter edges of the panel member 20 to remove any excess material or stock from the overlapping portion X of the panel member 20 (Block 305, FIG. 4). As may be realized a substantially similar method of installing the crawlspace access panel may be used where the threaded rod 60 is fixed to the anchor 70 in that the panel 20 can be placed on the threaded rods 60 (which are fixed in the wall with the anchors) via the holes 80 and a knob having the threaded hole can be removably threaded onto the rods 60 thereby securing the panel 20 to the wall 90.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A crawlspace access panel assembly for covering a crawlspace accessway opening through a building exterior wall, the assembly comprising:

a substantially rigid structural foam panel member of one piece unitary construction adapted to cover the opening, the opening being sized to provide a person passage through the opening;

a seal attached around a perimeter of the substantially rigid panel; and a number of fasteners connected to the substantially rigid panel for removably fastening the substantially rigid panel to the exterior wall, the fasteners being located only on a minimum number of sides of the substantially rigid panel to stably hold the panel to the exterior wall, wherein when fastened the fasteners only on the minimum number of sides of the substantially rigid panel urge the panel against an outer surface of the exterior wall on which the panel is seated causing the seal to seat around the perimeter so that the substantially rigid panel seals the opening, wherein the rigid panel member is substantially rigid such that there is substantially no deflection of the panel member and the seal forms a substantially airtight seal around the perimeter with the use of only two of the number of fasteners to urge the panel against the exterior wall, and wherein edges of the substantially rigid panel overlap the opening, the edges seated against the outer surface of the exterior wall.

2. The crawlspace access panel assembly of claim 1, wherein the fasteners are located outward of the seal and on a portion of the substantially rigid panel that overlaps the opening, the fastener being located on opposite sides of the rigid panel member.

3. The crawlspace access panel assembly of claim 1, wherein the fasteners comprise an anchor and a knob/screw assembly for insertion into the anchor.

4. The crawlspace access panel assembly of claim 1, wherein the fasteners comprise a knob having a threaded hole and an anchor/threaded post assembly wherein the knob is threaded onto the anchor/threaded post assembly.

5. The crawlspace access panel assembly of claim 1, wherein the seal seals the substantially rigid panel against unprepared surfaces of the building exterior wall.

6. The crawlspace access panel assembly of claim 1, wherein the fasteners comprise a corrosion resistant material.

7. The crawlspace access panel assembly of claim 1, wherein the fasteners comprise through fasteners.

8. The crawlspace access panel assembly of claim 1, wherein there are two fasteners.

9. The crawlspace access panel assembly of claim 1, wherein the minimum number of sides is two.

10. The crawlspace access panel assembly of claim 9, wherein the two sides are located opposite each other.

11. The crawlspace access panel assembly of claim 1, wherein the fasteners have hand grasping portions disposed thereon so that a user grasping the hand grasping portions can secure the fastener to seat the seal and effect sealing.

12. The crawlspace access panel assembly of claim 11 wherein the hand grasping portions comprises a T-handle nut.

13. A crawlspace encapsulation system for a crawlspace environment of a building having:

a continuous sealed plastic liner barrier layer covering an entire floor of the crawlspace, the barrier layer having vertical extensions which extend vertically upward against an interior peripheral foundation of the building to a height grater than the corresponding ground level at an exterior surface of the foundation, the vertical extensions being bonded to the interior peripheral foundation by a continuous seal adjacent to upper edges of the extensions; and an access panel assembly for covering a crawlspace accessway opening through the foundation according to claim 1.

14. A crawlspace access panel assembly for covering a crawlspace accessway opening through a building exterior wall, the assembly comprising:

a structural foam panel of one piece unitary construction adapted to cover the opening in the building exterior wall, the opening being sized to provide a person passage through the opening;

a sealing member attached around a perimeter of the structural foam panel, the sealing member being on a side of the structural foam panel, wherein the sealing member effects sealing between the structural foam panel and the building exterior wall; and a number of fasteners connected to the structural foam panel for removably fastening the structural foam panel to the exterior wall, wherein the structural foam panel is substantially rigid such that when fastened only one pair of fasteners will stably seat the structural foam panel against an outer surface of the exterior wall on which the panel is seated and there is substantially no deflection of the structural foam panel causing the sealing member to seal the opening around the perimeter of the panel with a substantially airtight seal with but the only one pair of fasteners fastening the structural foam panel against the exterior wall; and wherein, the structural foam panel is removably secured to the building exterior wall, and wherein edges of the substantially rigid panel overlap the opening, the edges seated against the outer surface of the exterior wall.

15. The crawlspace access panel assembly of claim 14, wherein the number of fasteners comprise at least one pair of fasteners extending through corresponding apertures in the structural foam panel.

16. The crawlspace access panel assembly of claim 15, wherein each fastener of the at least one pair of fasteners comprises an anchor and a knob/screw assembly for insertion into the anchor.

17. The crawlspace access panel assembly of claim 15, wherein the at least one pair of fasteners are located outward of the sealing member and on a portion of the structural foam panel that overlaps the opening in the building exterior wall, each fastener of the at least one pair of fasteners being located on opposite sides of the structural foam panel.

18. The crawlspace access panel assembly of claim 14, wherein the sealing member seals the structural foam panel against unprepared surfaces of the building exterior wall.

19. The crawlspace access panel assembly of claim 14, wherein the number of fasteners comprise a corrosion resistant material.

20. A crawlspace encapsulation system for a crawlspace environment of a building having:

a continuous sealed plastic liner barrier layer covering an entire floor of the crawlspace, the barrier layer having vertical extensions which extend vertically upward against an interior peripheral foundation of the building to a height grater than the corresponding ground level at an exterior surface of the foundation, the vertical extensions being bonded to the interior peripheral foundation by a continuous seal adjacent to upper edges of the extensions; and an access panel assembly for covering a crawlspace accessway opening through the foundation according to claim 14.

21. A method of installing a crawlspace access panel assembly for covering a crawlspace accessway opening through a building exterior wall, the method comprising:

providing a substantially rigid structural foam panel of one piece unitary construction having a seal attached around a perimeter of the substantially rigid panel;

providing at least two removable fastening members each having an anchor and a knob/screw assembly for insertion into the anchor;

securing the anchors of the at least two removable fastening members within the building exterior wall on opposite sides of the crawlspace accessway opening;

placing the substantially rigid panel over the crawlspace accessway opening in the building exterior wall and closing a passage for a person through the access opening into the crawlspace;

removably inserting the knob/screw assembly of the at least two removable fastening members through a corresponding aperture in the substantially rigid panel and into a corresponding anchor thereby forming a substantially airtight seal with the use of only two of the removable fasteners; and urging the panel with the fastening members against an outer surface of the exterior wall on which the panel is seated, wherein edges of the substantially rigid panel overlap the opening, the edges seated against the outer surface of the exterior wall.

22. The method of claim 21, further comprising trimming a perimeter edge of the substantially rigid panel.

23. The method of claim 21, wherein the seal provides the substantially airtight seal between the substantially rigid panel and an unprepared surface of the building exterior wall.

* * * * *